United States Patent [19]

Simmons

[11] 4,282,927

[45] Aug. 11, 1981

[54] MULTI-PASS HEAT EXCHANGER CIRCUIT

[75] Inventor: Carl E. Simmons, Oxford, Ohio

[73] Assignee: United Aircraft Products, Inc., Dayton, Ohio

[21] Appl. No.: 25,773

[22] Filed: Apr. 2, 1979

[51] Int. Cl.[3] ..... F28F 3/02

[52] U.S. Cl. ..... 165/166

[58] Field of Search ..... 165/166

[56] References Cited

U.S. PATENT DOCUMENTS

| | | | |
|---|---|---|---|
| 3,016,921 | 1/1962 | Tadewald | 165/166 |
| 3,380,517 | 4/1968 | Butt | 165/166 |
| 3,542,124 | 11/1970 | Manfredo | 165/166 |
| 4,141,412 | 2/1979 | Culbertson | 165/166 |

FOREIGN PATENT DOCUMENTS

| | | | |
|---|---|---|---|
| 313863 | 5/1956 | Switzerland | 165/166 |

*Primary Examiner*—Samuel Scott
*Assistant Examiner*—Theophil W. Streule, Jr.
*Attorney, Agent, or Firm*—J. E. Beringer

[57] ABSTRACT

A concept for reducing the number of parts in, and for simplifying the assembly of, a plate and fin type heat exchanger in which a fluid makes plural passes at least at one level of the heat exchanger. A single layer of a secondary heat transfer material replaces multiple detail parts of the prior art and is appropriately configured in conjunction with flow divider members to assure continuous fluid flow to and between fluid passes.

8 Claims, 5 Drawing Figures

MULTI-PASS HEAT EXCHANGER CIRCUIT

BACKGROUND OF THE INVENTION

In plate and fin heat exchangers, a "fin" layer of a relatively ductile sheet or strip material, crimped to a corrugated configuration, is placed between overlying and underlying plates where it acts as a secondary heat transfer surface. In some instances, particularly in the case of compact, high performance heat exchangers, it is possible or desirable, or both, to conduct at least one of the fluids admitted to the heat exchanger in a serpentine or reversing flow path between adjacent plates. This poses a problem in respect of the "fin" layer since flow in a serpentine path has components of transverse movement which cannot obviously be accommodated by the as-formed corrugated "fin" material. In the known prior art, this problem has been dealt with by using a "fin" layer comprised of multiple "fin" segments including a connecting segment in which the corrugations orient at right angles to the corrugations of connected segments. The segments are configured to achieve miter joints at turn-around locations. This practice satisfactorily solves the problem of impeded flow but is a relatively costly solution. Multiple "fin" segments of different configuration must be provided, and separately and selectively laid in place in assembling each level of a plate and fin heat exchanger. The advantages of a multi-pass heat exchanger accordingly have heretofore been possible only by an expenditure of relatively high materials and labor costs.

SUMMARY OF THE INVENTION

A multi-pass plate and fin heat exchanger of the instant invention retains basic structural and operational details of the prior art. In lieu of a segmental, mitered "fin" layer, however, it substitutes a single, one-piece layer of material which can be constructed and assembled in the heat exchanger in substantially the same manner as would be done in constructing a single pass heat exchanger. The problem of impeded flow is obviated by giving the fin corrugations a slitted, or lanced, configuration enabling fluid flow to take place through the corrugations in a sense laterally or transversely thereof. The slited or lanced configuration may appear throughout the length of the corrugations, or may be limited to locations where the flowing fluid is required to move in a sense transversely of the fin corrugations. In an optional practice of the invention, the fin layer is configured with transverse slots at locations of transverse flow, and these may be used instead of or in addition to a slit or lanced fin configuration.

An object of the invention is to provide a multi-pass heat exchanger circuit substantially as set forth in the foregoing.

Other objects and structural details of the invention will appear more clearly from the following description, when read in connection with the accompanying drawings, wherein.

Figure 1:
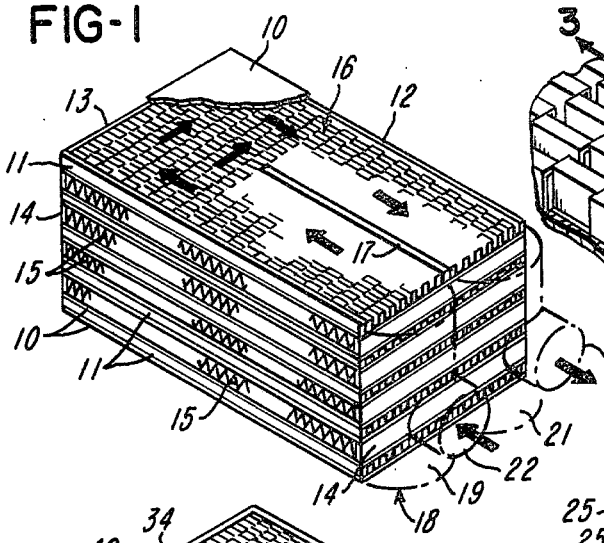
FIG. 1 is a view in perspective, partly diagrammatic, of a plate and fin heat exchanger core made in accordance with an illustrated embodiment of the invention.

Referring to the drawings, a plate and fin heat exchanger core in accordance with an illustrated embodiment of the invention may assume a form substantially as is indicated in partly diagrammatic form in FIG. 1. The structure there illustrated is adapted to place separate, non-communicating fluids in a heat transfer relation through a series of vertically spaced apart plates 10. The plates 10 are held in a superposing, spaced apart relation by means including side bars or "nose-pieces" 11 and 12, end bars or nose-pieces 13 and channel shaped members 14. The core device is in the illustrated instance generally rectangular in configuration. Channel members 14 position between an adjacent pair of plates 10 and at opposite ends thereof. They confine between them a secondary heat transfer material in the form of a corrugated fin means 15 oriented so that the corrugations thereof extend in a direction laterally or transversely of the length of the heat exchanger core. A pair of oppositely positioning channel members 14 is in an alternating relation to an arrangement of marginal nose-pieces 11, 12 and 13 which effectively close three sides of the core at levels above and below the level at which channel members 14 position. Within a flow area bounded by the nose-pieces 11, 12 and 13 is a layer of fin material 16, to be more particularly considered hereinafter, and a divider member 17. The latter locates intermediately of the nose-pieces 11 and 12 and lies in a parallel relation thereto. At its one end, the divider member 17 terminates substantially at one end of the core or at an end coincident with an end of the fin layer 16. At its opposite end, divider member 17 terminates within the described flow area or short of end nose-piece 13, the latter marking the opposite terminus of the fin layer 16.

It will be evident that a heat exchanger core substantially as shown in FIG. 1 is constructed by a stacking of parts to assume substantially the relationship illustrated. Thus, a bottom or base plate 10 has a pair of channel members 14 placed thereon and between the channel members 14 is placed a strip of corrugated secondary heat transfer material 15. These parts are followed by another plate 10 and on this plate is placed side bars or nose-pieces 11 and 12 and an end nose-piece 13. Within the area bounded by these parts there is placed a layer of a secondary heat transfer surface material 16 and a divider member 17. This is followed by another plate 10 and by additional channel members 14 and secondary surface material 15, and by another plate 10 and so on until a heat exchanger core of the desired number of vertical layers or flow passes has been assembled. The parts are appropriately held in an assembled relation in a jig, fixture or the like and while so held are subjected to a metallurgical joining operation, as for example brazing. In this connection, the parts may, prior to assembly, be coated with a braze alloy so that when the assembly is complete and upon the assembled core being subjected to an appropriate heating and cooling operation, the braze alloy will flow and harden to establish a seal and a bond between contacting parts. The secondary heat transfer surface or fin material 15 and 16 has the peaks and valleys thereof in contact with overlying and underlying plates 10. As a part of the brazing operation, the fin material accordingly is joined to the plates and by being bonded thereto establish ties between adjacent plates strongly reinforcing the heat exchanger core against disruptive effects of fluid pressure. At the same time, since the peaks and valleys of the fin material are in contacting, sealed relation to adjacent plates, an intercommunication of flowing fluid between adjacent fin corrugations over and under the peaks and valleys thereof is impossible.

As is evident from the illustration of FIG. 1, the described construction forms flow passes for the different fluids which are substantially at right angles to one another. By appropriate manifolding, ducting or the like, a first fluid is brought to one or the other sides of the heat exchanger core and admitted to passages occupied by fin material 15 and defined by channel members 14. This fluid flows in a single pass through such passages, entering on one side of the core and exiting at the other. Simultaneously, a second fluid is brought to what may be regarded as an open end of the heat exchanger core, or that end opposite the end occupied by nose-pieces 13. Again, suitable manifolding or ducting means is provided. In the illustrated instance, the presence of a mainfold 18 is indicated which provides a separate chamber 19 and a chamber 21 in communication respectively with end portions of the heat exchanger core which lie to opposite sides of divider members 17. Through respective ports 22 and 23, the chambers 19 and 21 communicate with a line flowing the described second fluid, and the ports 22 and 23 may function alternatively as the inlet and the outlet for the second fluid. In the case of the second fluid, therefore, it is admitted to the heat exchanger core by way of port 22 and chamber 19, for example, and flows longitudinally within a flow area defined by side nose-piece 11 and divider member 17 in the direction of end nose-piece 13. After passing beyond the inner end of divider member 17, the fluid is able to flow transversely or toward side nose-piece 12 (in a manner to be discussed more particularly hereinafter) and then moves in a sense reversely of its former flow back in the direction of manifold 18 where it enters chamber 21 and discharges by way of outlet 23. Within the heat exchanger core, therefore, the described first and second fluids are in a heat transfer relation through separating plates 10, with fin material 15 and 16 providing secondary heat transfer surface promoting a better and more efficient transfer of heat between the separated fluids. In the illustrated instance, the described first fluid has a single pass through the heat exchanger core whereas the described second fluid is constrained to move in a serpentine or reversing flow path. The arrangement is generally one of cross flow fluid movement, with components of counterflow in those portions of the heat exchanger core in which the described second fluid makes a turn around the inner free end of the divider members 17.

Figure 2:
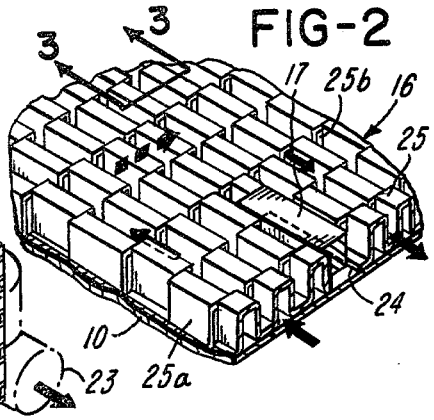
FIG. 2 is a detail view in perspective of a portion of the core of FIG. 1.
Figure 3:
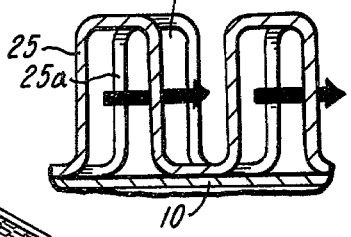
FIG. 3 is a detail view, taken substantially along the line 3—3 of FIG. 2.

Referring more particularly to FIGS. 2 and 3, the fin layer 16 is seen to be a one-piece, lanced article, formed with an elongated slot 24 positioned to accommodate the divider member 17. The slot 24 accordingly opens through one end of the fin layer 16 and terminates well short of the opposite end. The fin layer is comprised of individual corrugations 25, each being "lanced" or cut along its length to provide offset portions **25*a* and open area 25*b*. Throughout their length, therefore, individual flow paths as defined by individual fin corrugations are in an intercommunicating relation with adjacent, like flow paths. Further, the open area 25*b* provides a route by which fluid may move in a sense transversely of the fin layer, as across a portion of the fin layer occupied by multiple corrugations. Referring again to FIG. 1, therefore, and to the flow circuit described in connection with the described second fluid, a fluid admitted to manifold chamber 19 and admitted to the flow passes occupied by fin layer 16 can move longitudinally along the several communicating corrugations 25 until it passes beyond a point of confinement as represented by the inner free end of divider member 17. Continued flow then is in a sense transversely of the fin layer and takes place through open area 25*b*. As the transversely flowing fluid reaches corrugations 25 positioning on the opposite side of divider member 17, it is enabled again to move in a sense longitudinally of the layer 16 and flows this time in a reverse direction back toward the manifold 18 and into manifold chamber 21 to be discharged by outlet 23**. The described second fluid accordingly completes plural passes through the heat exchanger core, which passes are interconnected by components of lateral or transverse flow enabled by the lanced fin construction.

For convenience of disclosure the invention has been shown in FIGS. 1 to 3 as comprised in a multi-pass heat exchanger in which the described second fluid completes its flow through the heat exchanger core in two passes or in what may be considered a single reversing path. It will be obvious that the serpentine or reversing movement of the fluid may include more than one turn around portion to provide an extended flow path of multiple reversing passes.

Figure 4:
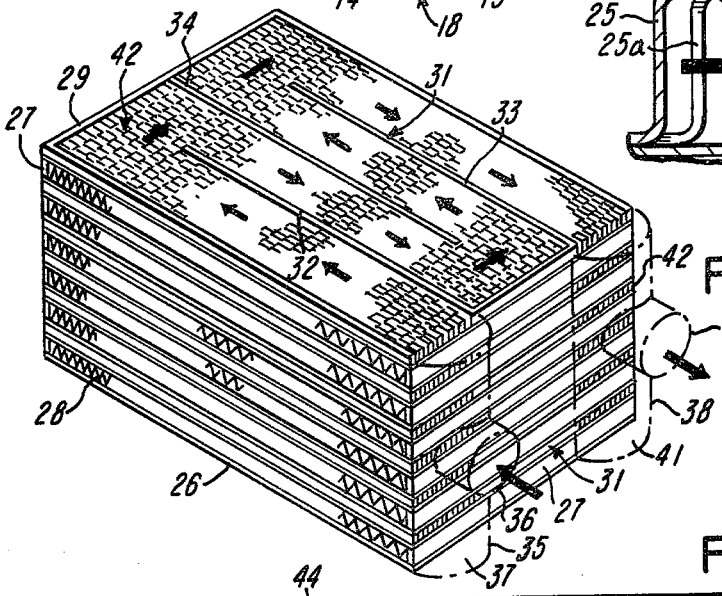
FIG. 4 is a view like FIG. 1, showing another form of the invention.

By way of example there is shown in FIG. 4 a modified multi-pass heat exchanger core in which plates 26 are separated in the one instance by channel members 27 and fin material 28 and in the other instance by nose-piece means 29 and 31, the arrangement insofar as the flow of the described first and second fluids is concerned being the same as described in connection with the embodiment of FIG. 1. Nose-piece means 29 is in this instance a one-piece part of U-shaped configuration and corresponds substantially to the side bars 11 and 12 and end member 13 of the first considered embodiment. Nose-piece means 31 is likewise of U-shaped configuration and has a telescopic reception within nose-piece means 29, in a reverse orientation. The inwardly projecting legs of U-shaped nose-piece means 31 form divider members 32 and 33. The nose-piece assembly is completed by a divider member 34 based in the closed end of nose-piece means 29 and projecting between the legs 32 and 33 toward but short of the closed end of nose-piece means 31. The open end of nose-piece 29, in conjunction with the closed end of nose-piece means 31, defines entrance and exit ends of a circuitous flow path for the described second fluid. A manifold 35 has a port 36 opening thereinto and provides a chamber 37 communicating with what may be regarded as the start of the circuitous flow path or that longitudinal portion lying between leg 32 and the adjacent leg of nose-piece means 29. A manifold 38 has a ported opening 39 and provides a chamber 41 communicating with what may be regarded as the exit end of the circuitous flow path, or that portion of the flow path lying between leg 33 and the adjacent leg of nose-piece means 29. At ends of the legs 32–33 and at the end of divider member 34, are turn-around portions of the circuitous flow path, or locations of transverse fluid flow. The area bounded by nose-piece means 29 is occupied by a one-piece layer of fin material 42 which may be a corrugated, lanced material essentially the same as the fin layer 16 of FIGS. 1 to 3. In this instance, however, the fin layer 42 is preformed with a plurality of slots of longitudinal extent respectively accommodating flow divider members 32–34. As in the case of the FIGS. 1–3 embodiment, the lanced configuration of the fin material provides for components of transverse or lateral flow at the turn-around locations beyond extremities of the legs 32–33 and member 34.

It will be understood that parts comprised in the embodiment of FIG. 4 are assembled and united into an integrated structure substantially in the same manner described in connection with the FIG. 1 embodiment.

Figure 5:
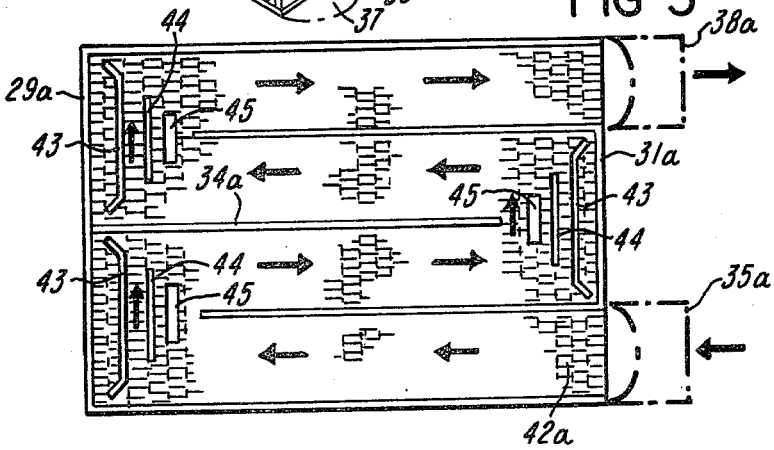
FIG. 5 is a view in longitudinal section through the heat exchanger of FIG. 4, showing a modified fin layer.

In the illustrated instances of FIGS. 1 and 4, the described second fluid is required to move transversely in turn-around locations through means providing for a relatively tortuous passage of the fluid, namely the fin open area 25*b*. It may be desirable to facilitate transverse flow with reduced resistance at the turn-around locations and to this end there is shown in FIG. 5 a modified form of fin layer, indicated at 42*a* therein. The fin layer is in an illustrated environment corresponding to that of FIG. 4 and like parts are given the same reference numeral identification in FIG. 5 as they have in FIG. 4, with the addition of the letter "a." Fin layer 42*a* may be made to a lanced configuration, as in the case of fin layers 16 and 42 or may be made to other, known configurations, as for example one in which the individual corrugations are straight and unapertured. In either event, the fin layer is further provided with a longitudinal series of transverse slots 43, 44 and 45 at each turn-around location. The slots 43–45 bridge the inner free end of each adjacent divider member 32–34 and intersect a selected number of corrugations in the fin layer. The slots 43–45 provide relatively low resistance flow paths whereby the described second fluid at the end of each longitudinal pass through the heat exchanger core may with greater ease and facility move transversely to the next following longitudinal pass segment. Low resistance passage means as represented by the slots 43–45 herein may be provided in whatever number and configuration may be found appropriate, having regard to involved fluid flow rates and heat transfer requirements. In the illustrated instance, slot 43 is relatively narrow and has divergent ends. Slot 44 is made without divergent ends and is relatively shorter than slot 43 but is somewhat wider. Slot 45 is relatively broad but short in length. In conjunction with one another, they provide for an intersection of all corrugations of adjacent flow passes.

In the illustrated instances of FIGS. 4 and 5, all successive portions of the circuitous flow path are occupied by a single, one-piece fin layer 42 or 42*a*. It will be understood that, if found necessary or desirable, there may be interposed at any location in such path a circuit component of the prior art, that is, one of relatively low flow resistance making use of multiple fin parts assembled in a miter joint.

The invention has been disclosed as comprised in certain illustrated embodiments, and modifications have been discussed. It will be evident that these and other modifications and embodiments, which will be obvious to persons skilled in the art, are fully comprised in the intent and concept of the invention.

What is claimed is:

1. A plate and fin heat exchanger in which a flowing fluid is compelled to make plural passes through the heat exchanger at least at one level thereof, including (a) superposing plates at said one level;

(b) marginal plate spacer means defining an internal flow area between said plates having an inlet and an outlet;

(c) at least one divider member positioning intermediately of said spacer means to have an inner end terminating within said flow area and defining with said spacer means and with one another a circuitous flow path between said inlet and said outlet including plural passes paralleling said divider member, said flow path further including a portion of transverse extent around the inner end of said divider member;

(d) and a single continuous layer of a secondary heat transfer material occupying the entirety of said flow area including said flow passes and said portion of transverse extent of said flow path and providing fin-like corrugations approximately parallel to said divider member and extending beyond the said inner end of said divider member to and through said portion of transverse extent of said flow path, said layer being slotted to accommodate said divider member;

(e) and corrugations of said layer being slit at least in the location of said flow path portion of transverse extent to provide for fluid flow transversely of said corrugations in said portion.

2. A plate and fin heat exchanger according to claim 1, said corrugations having a lanced configuration throughout their lengths.

3. A plate and fin heat exchanger according to claim 1, said corrugations being slit only in the flow path portion of transverse extent.

4. A plate and fin heat exchanger according to claim 1, wherein slits in said corrugations include slotted formations bridging adjacent corrugations in the flow path portion of transverse extent.

5. A plate and fin heat exchanger according to claim 4, wherein said slotted formations include a longitudinal series of slots of different lateral extent.

6. A plate and fin heat exchanger according to claim 5, wherein the slots of said longitudinal series differ in configuration.

7. A plate and fin heat exchanger according to claim 1:

(a) said marginal plate spacer means and said divider member having U-shaped configurations and occupying a nested relation to one another in a reverse orientation;

(b) the closed end of the U-shaped divider member separating the inlet and the outlet and legs of said U-shaped divider member extending in parallel laterally spaced relation to terminate in respectively different inner ends;

(c) said single layer being transversely slotted in a limited area beyond each of said respectively different inner ends to provide for said transverse fluid flow.

8. A plate and fin heat exchanger according to claim 7, the transverse slotting of said layer comprising a longitudinal series of slots positioning entirely within a respective flow path portion of transverse extent and in a sense perpendicular to the adjacent inner end of a respective divider member.

* * * * *